US011344124B1

(12) United States Patent
Tham

(10) Patent No.: US 11,344,124 B1
(45) Date of Patent: May 31, 2022

(54) LOUNGER WHICH MAY BE SLID OR FOLDED INTO COMPACT FORM

(71) Applicant: Noble House Home Furnishings, LLC, Chatsworth, CA (US)

(72) Inventor: Siew Kin Tham, Chatsworth, CA (US)

(73) Assignee: NOBLE HOUSE HOME FURNISHINGS LLC, Chatsworth, CA (US)

( * ) Notice: Subject to any disclaimer, the term of this patent is extended or adjusted under 35 U.S.C. 154(b) by 0 days.

(21) Appl. No.: 16/752,975

(22) Filed: Jan. 27, 2020

Related U.S. Application Data

(60) Provisional application No. 62/796,713, filed on Jan. 25, 2019.

(51) Int. Cl.

| | |
|---|---|
| ***A47C 1/14*** | (2006.01) |
| ***A47C 4/10*** | (2006.01) |
| ***A47C 4/14*** | (2006.01) |
| ***A47C 7/50*** | (2006.01) |
| ***A47C 7/16*** | (2006.01) |
| ***A47C 1/026*** | (2006.01) |
| ***A47C 4/12*** | (2006.01) |

(52) U.S. Cl.
CPC ..... *A47C 1/143* (2013.01); *A47C 1/026* (2013.01); *A47C 4/10* (2013.01); *A47C 4/12* (2013.01); *A47C 7/16* (2013.01); *A47C 7/5062* (2018.08); *A47B 2220/0055* (2013.01)

(58) Field of Classification Search
CPC .. A47C 1/143; A47C 4/10; A47C 4/14; A47B 2220/0055
USPC ..... 297/16.2, 54, 55, 233, 236, 354.12, 297/354.13, 357, 452.63, 423.26, 423.27, 297/423.36, 378.1
See application file for complete search history.

(56) References Cited

U.S. PATENT DOCUMENTS

| | | | | | |
|---|---|---|---|---|---|
| 455,933 | A * | 7/1891 | Timmons | A47C 7/024 | 297/233 |
| 543,681 | A * | 7/1895 | Fortier | B60N 2/3084 | 297/112 |
| 1,241,907 | A * | 10/1917 | Bernhard | A47C 4/10 | 297/54 |
| 1,631,811 | A * | 6/1927 | Guenther | A47C 1/026 | 297/188.11 |

(Continued)

FOREIGN PATENT DOCUMENTS

| | | | | |
|---|---|---|---|---|
| BE | 1008843 | A3 * | 8/1996 | A47C 7/405 |
| CA | 2940254 | A1 * | 3/2016 | A47C 1/143 |

(Continued)

*Primary Examiner* — Robert Canfield
(74) *Attorney, Agent, or Firm* — Colin P. Abrahams

(57) ABSTRACT

A sliding lounger comprises a seating portion having seating slats and seating spaces between the seating slats, a back support portion having back slats and back spaces between the back slats, the back slats being receivable within the seating spaces and the seating slats being receivable within the back spaces, and a foot support portion having foot slats and foot spaces between the foot slats, the foot slats being receivable within the seating spaces, and the seating slats being receivable within the foot spaces. The back portion and foot support portion move between an open position where the back and foot slats are not received within the seating spaces and a compact position where the back and foot slats are received within the seating spaces.

10 Claims, 4 Drawing Sheets

(56) References Cited

U.S. PATENT DOCUMENTS 2,223,261 A * 11/1940 Mende ..... A47C 17/2073 297/108
2,483,309 A * 9/1949 Amaducci ..... A47C 4/10 297/54
2,567,626 A * 9/1951 Trouslot ..... A47C 1/143 297/294
2,798,537 A * 7/1957 Bird ..... A47C 7/32 160/371
3,907,359 A * 9/1975 Joiner ..... A47C 7/405 297/18
D249,305 S * 9/1978 Henninger ..... D6/336
4,239,280 A * 12/1980 Ackerman ..... A47C 4/14 248/164
D260,459 S * 9/1981 Lamb ..... D6/368
D260,705 S * 9/1981 Zamora ..... D6/370
4,322,109 A * 3/1982 Thebaud ..... A47C 4/022 108/118
4,792,182 A * 12/1988 McLeod ..... A47C 4/025 297/340
5,519,902 A * 5/1996 Meade ..... A47C 17/161 297/354.13
D443,148 S * 6/2001 Vertongen ..... D6/361
D443,768 S * 6/2001 Vertongen ..... D6/361
D481,878 S * 11/2003 Engelen ..... D6/361
10,188,206 B2 * 1/2019 Leathead ..... A47B 3/08
10,231,553 B1 * 3/2019 Gregory ..... A47C 19/04
2006/0186711 A1 * 8/2006 Phipps ..... A47C 4/14 297/46
2012/0256467 A1 * 10/2012 Pettingill ..... A47C 23/06 297/452.55

FOREIGN PATENT DOCUMENTS

GB 2243543 A * 11/1991 ..... A47C 13/00
GB 2522676 A * 2/2014 ..... A47C 11/00

* cited by examiner

LOUNGER WHICH MAY BE SLID OR FOLDED INTO COMPACT FORM

CROSS-REFERENCE TO RELATED APPLICATIONS

This application claims the benefit of United States Provisional Patent Application No. 62/796,713 filed Jan. 25, 2019, the contents of which are incorporated by reference in their entirety.

FIELD AND BACKGROUND OF THE INVENTION

This invention relates to a sliding lounger. More particularly, the invention relates to seating in the form of a chair or lounger, including a seating surface and a back support surface.

SUMMARY OF THE INVENTION

Chairs or loungers are well recognized types of furniture and may come in a wide variety of different shapes, sizes and configurations. A lounger may typically be described, without limiting the scope of the present invention, as a comfortable couch or seating device, or an extending chair, designed for a person to relax upon. While loungers are appropriate for both indoor and outdoor usage, such loungers are often utilized outdoors, sometimes in the form of sun chairs.

According to one aspect of the invention, there is provided a sliding lounger comprising: a seating portion comprising a plurality of substantially parallel seating slats and seating spaces between the seating slats; a back support portion comprising a plurality of substantially parallel back slats and back spaces between the back slats, the back slats being receivable within the seating spaces and the seating slats being receivable within the back spaces; a foot support portion comprising a plurality of substantially parallel foot slats and foot spaces between the foot slats, the foot slats being receivable within the seating spaces, and the seating slats being receivable within the foot spaces; wherein the back support portion is movable between an open position in which at least a part of the back slats are not received within the seating spaces and a compact position in which the back slats are substantially received within the seating spaces; and wherein the foot support portion is movable between an open position in which at least a part of the foot slats are not received within the seating spaces and a compact position in which the foot slats are substantially received within the seating spaces.

The back slats may be substantially fully received within the seating spaces when in the compact position, and the foot slats may be substantially fully received within the seating spaces when in the compact position. The seating spaces may comprise a width which is sufficient to accommodate the back slats and the foot slats.

Preferably, the back slats are receivable within the slat spaces and the seat slats are receivable within the back spaces by sliding each into the other when coplanar with each other. Further, the foot slats are receivable within the slat spaces and the seat slats are receivable within the foot spaces by sliding each into the other when coplanar with each other.

The back support portion may be angularly pivotable relative to the seating portion to a selected angular position, and selectively placed at any angular position. The foot portion may be angularly pivotable relative to the seating portion to a selected angular position.

In one embodiment, the sliding lounger further comprises a back support frame in which the back support portion is located, the back support frame being slidable with the back support portion between an open position and a closed position, the back support frame being adjacent the seating portion when in the closed position.

The seating portion may be pivotable relative to the back support frame, and there may be a bracket mounted on the back support portion and notches formed in the back support frame, the bracket being selectively engageable with one of the notches so as to maintain the back support portion at a selected angular position.

A foot support frame in which the foot support portion is located may be provided, the foot support frame being slidable with the foot support portion between an open position and a closed position, the foot support frame being adjacent the seating portion when in the closed position.

Preferably, there are a plurality of legs for supporting the seating portion, back portion and foot support portion. The legs may be movable between an extended position for supporting the sliding lounger and a compact or folded position.

According to a further aspect of the invention, there is provided a sliding lounger comprising: a seating portion comprising a plurality of substantially parallel seating slats and seating spaces between the seating slats; a back support portion comprising a plurality of substantially parallel back slats and back spaces between the back slats, the back slats being receivable within the seating spaces and the seating slats being receivable within the back spaces; and wherein the back support portion is movable between an open position in which at least a part of the back slats are not received within the seating spaces and a compact position in which the back slats are substantially received within the seating spaces.

Preferably, the back support frame and the foot support frame are movable between a first open position and a second closed position, the back support portion moving with the back support frame and the foot support portion moving with the foot support frame, the back support frame and the foot support frame surrounding the seating portion when in the second closed position and abutting each other, the back support frame and the foot support frame being away from the seating portion when in the first open position and distanced from each other.

According to a further aspect of the invention, there is provided a method of making an operating a sliding lounger, the method comprising: providing a seating portion comprising a plurality of substantially parallel seating slats and seating spaces between the seating slats; providing a back support portion comprising a plurality of substantially parallel back slats and back spaces between the back slats, the back slats being receivable within the seating spaces and the seating slats being receivable within the back spaces; providing a foot support portion comprising a plurality of substantially parallel foot slats and foot spaces between the foot slats, the foot slats being receivable within the seating spaces, and the seating slats being receivable within the foot spaces; moving the back support portion between an open position in which at least a part of the back slats are not received within the seating spaces and a compact position in which the back slats are substantially received within the seating spaces; and moving the foot support portion between an open position in which at least a part of the foot slats are not received within the seating spaces and a compact position in which the foot slats are substantially received within the seating spaces.

In accordance with the present invention, there is thus provided a lounger in the form of a regular chair or an extended chair. The lounger has a seating support or surface. In a regular chair, the seating support or surface may be of shorter length, and support the upper legs or thighs, so that the lower legs are able to hang unsupported over the edge of such seating support of the chair. In an extended chair, the seating support or surface is of course longer, and may typically be of a length which may be suitable for supporting a person's legs and feet entirely, or at least most of the legs.

In accordance with the invention, the lounger has, in addition to the seating support or surface, a back support. Preferably, the back support has a first end which connects to, or near, the seating support or surface, and a second end opposite thereto, which is often free and not connected to anything further. However, headrests may be provided at or near the second end of the back support.

Preferably, the back support is connected to or near the seating support in a manner which allows the plane of the back support to be pivoted or rotatable relative to the plane of the seat support at the point at which the two connect or join to each other, or near the point where they are adjacent to each other. The back support may preferably be arranged in a preferred or selected position based on the extent of pivoting at different angles relative to the seating support, so that the person utilizing the lounger may be horizontal or close to horizontal, or the back support is pivoted so as to approach a vertical position to allow the person utilizing the lounger to be in a substantially sitting position. Of course, the back support may be rotatably placed at any intermediate position between completely flat and substantially vertical, as selected by the user.

Furthermore, the back support preferably includes a mechanism whereby the back support may be releasably secured in the selected orientation or position relative to the seating support, so as to maintain that position until moved by the user, either to another desired position, or to a folded and stored condition, as will be described further below.

In a preferred form of the invention, the seating portion is comprised by a plurality of spaced slats. Preferably, the slats are equally spaced from each other and the spaces have a width which may be approximately equal to, or slightly greater than, the width of the slat itself. Furthermore, the back support portion may also be comprised of a plurality of spaced slats, the spaces having a width approximately equal to that of the slat itself. The back portion and seating portion are preferably connected to each other in a manner whereby each of the slats of the seating portion is received within a corresponding space between each of the slats in the back portion, while each of the slats of the back portion is received within a corresponding space between each of the slats in the seating portion. The end or edge slats on both the seating portion and the back portion will be adjacent a corresponding slats, but not in a space as defined.

In one embodiment, an elongate rod or other type of connector may extend through the slats of both the seating portion and the back portion, at their engagement point or area of overlap, to facilitate pivotal and rotatable movement between them so that the back portion can be rotated and arranged in a position relative to the seat portion according to the preferences of the user. To accomplish accommodation of the elongate rod or other type connector, each of the slats of the back portion and the seating portion will have drilled apertures extending therethrough, all coaxial, so that the elongate rod can be easily slurred through such plurality of apertures. Preferably, these apertures will have a diameter which is just slightly greater than the diameter of the elongate rod.

In another aspect of the invention, the back portion and the seating portion can be folded together by sliding the back portion into the seating portion. In this regard, the slats of the back portion will be received in the spaces between the slats of the seating portion, and the slats of the seating portion will be received in the spaces between the slats of the back portion. A mechanism for sliding the back portion and the seat portion relative to each other between a compacted an extended position is therefore provided. However, it should be noted that the back portion, when in the extended position, is still able to rotate or pivot about a point near it space so that the back portion will still be able to be moved in orientation to a selected angular position.

In one embodiment, the lounger of the invention may be mounted on one or more frames, which may comprise a pair of longer sides and a pair of shorter sides joined together to form a generally rectangular frame configuration. Preferably, the frame is mounted on legs or supports, preferably several and four in one embodiment so that the frame, in use, is at a convenient and conventional distance above the surface on which it is standing. It is within the scope of the invention that the legs or supports may be adjustable so that the height of the frame, when positioned over the surface on which it is standing, may be varied by the user according to specific preferences.

In a preferred embodiment, at least two of the frames are positioned at the points where the seating portion joins with either the back portion, or a foot portion, and will in one embodiment each encompass either the back portion or the foot portion. The frames may cooperate with the connection between the seating portion and the back portion, and particularly the elongate rod where used, so as to form part of the assembly which allows relative movement between the different portions of the lounger. In another embodiment, the frames around the back portion and the foot portion slide with the respective back portion and foot portion between an open and closed position, wherein the back portion and foot portion have slats and slats spaces which accommodate the slats and slats spaces of the seat portion.

In one embodiment, the frames are comprised of a total length which is equal to the sum of the seating portion length. In this manner, when the back portion is fully horizontal and substantially coplanar with the seating portion, the back portion will be contained within the frame in addition to the seat portion, both of which will preferably be appropriately supported and contained therein.

The lounger of the invention may also be configured so that the back portion can fold forwardly so that the plurality of slats thereof are folded substantially completely within the plurality of spaces as defined by the slats in the seating portion. This folded up configuration may be advantageous for storage purposes, and thereby reduce the size and footprint of the lounger when stored or simply not in use.

In the above situation, the frame may be constructed as well so that it is foldable or slidable, according to the manner by which it may be compacted and opened, and the fold may be located at the point where the back portion meets the seat portion. In this way, when the back portion is folded into the seat portion as described above, that part of the frame portion which receives the back portion can also be folded over through approximately 180°, so that the length of the lounger is reduced into this compacted form. Furthermore, the legs or supports upon which the frame is mounted, both at the foot portion as well as the back portion, may be preferably foldable between an extended position in which they support the seating and back at a selected distance above the ground, and a collapsed position in which they are moved through approximately 90° so as to abut against the seating portion or back portion, once more reducing the footprint of the lounger significantly so that transportation and storage of the lounger can be conveniently and efficiently achieved. The legs may fold into the frame portion so as to attain further compactness.

The lounger of the invention may be configured so as to fold into a shape and size which corresponds to a standard size, and fit efficiently into a standard or commonly used carton or other type of container typically used by courier and transportation companies. One such carton is illustrated in FIG. 4 of the drawings.

In accordance with a further embodiment of the invention, the lounger of the invention may be configured so as to have a back portion at each end of the seating portion, or a back portion and foot/leg portion respectively. These back and foot portions may be substantially the same in their structure, configuration, and operation, as well as the manner in which they attach to the seating portion and fold or slide relative thereto. In this way, one back portion may be raised or rotated to a selected position to suit the user, while the opposing back portion may remain substantially flat or horizontal, operating, for example, to support the feet or legs. The user can choose which one of the back portions to pivot or rotate into position, and this may depend upon where or in which direction the user would like to face while seated on the chair. The back portion which is not selected by the user as a back support may be used as a foot or leg support, and oriented at angles selected by the user to meet comfort and convenience requirements. Alternately, the back portion of the lounger which is not being used may be foldable into a position where it is not used, so that the legs of the user can simply be positioned over the edge of the seating portion, as will be possible in an ordinary conventional chair, thereby rendering the lounger into a configuration corresponding to that of a regular chair.

When two back portions are provided, one back portion may be raised to support the back at the desired angle, while the opposing back portion may be either angled slightly upward to elevate the feet and legs of the user, or angled slightly downward so that the feet and legs of the user slope downwardly. Other positioning of such a back portion may also fall within the scope of the invention. With these choices, it will be appreciated that the lounger of the invention provides multiple and variable beneficial position options so that it can be configured into a position which is most comfortable and optimal for the user.

DETAILED DESCRIPTION OF THE INVENTION

Figure 1:
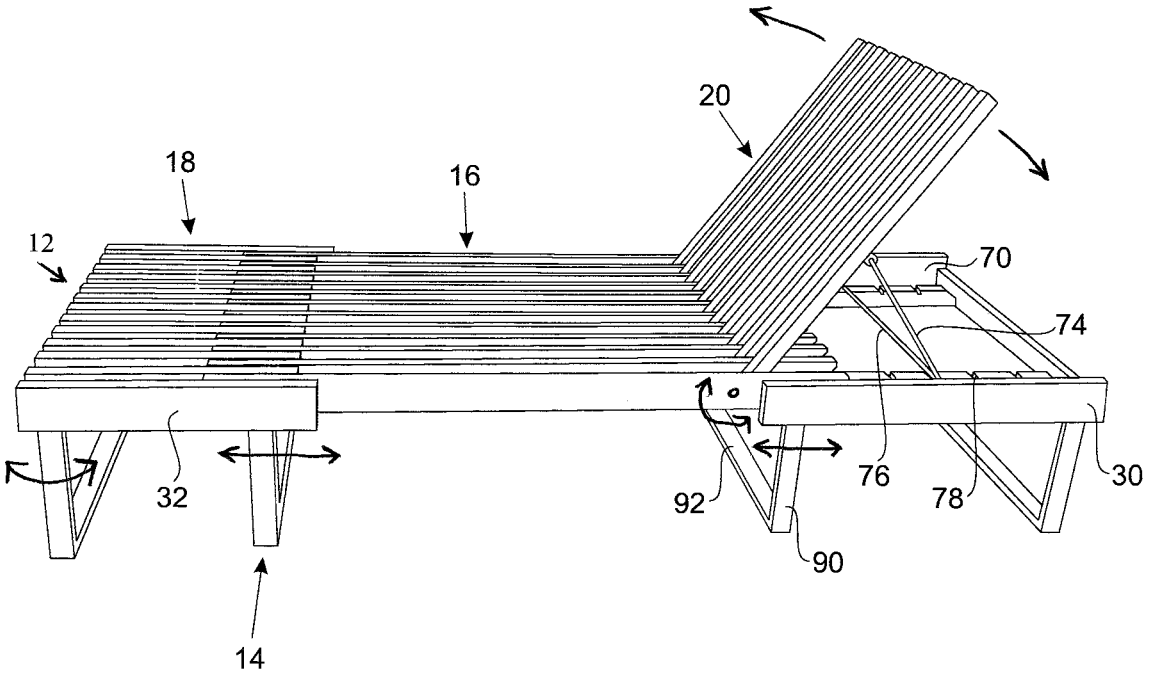
FIG. 1 is a side perspective view of a lounger in accordance with the invention.
Figure 2:
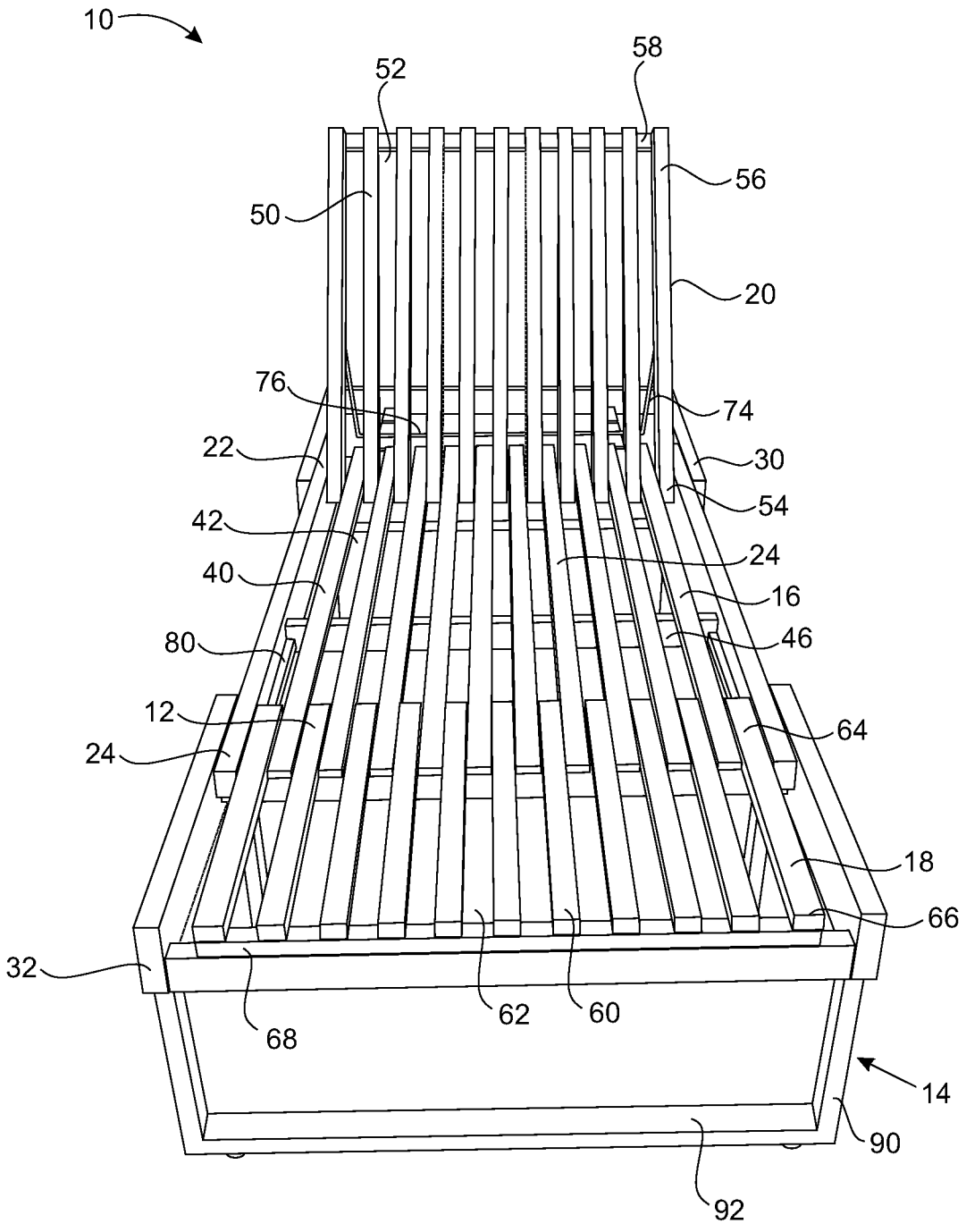
FIG. 2 is a front perspective view of the lounger as shown in FIG. 1 of the invention.
Figure 3:
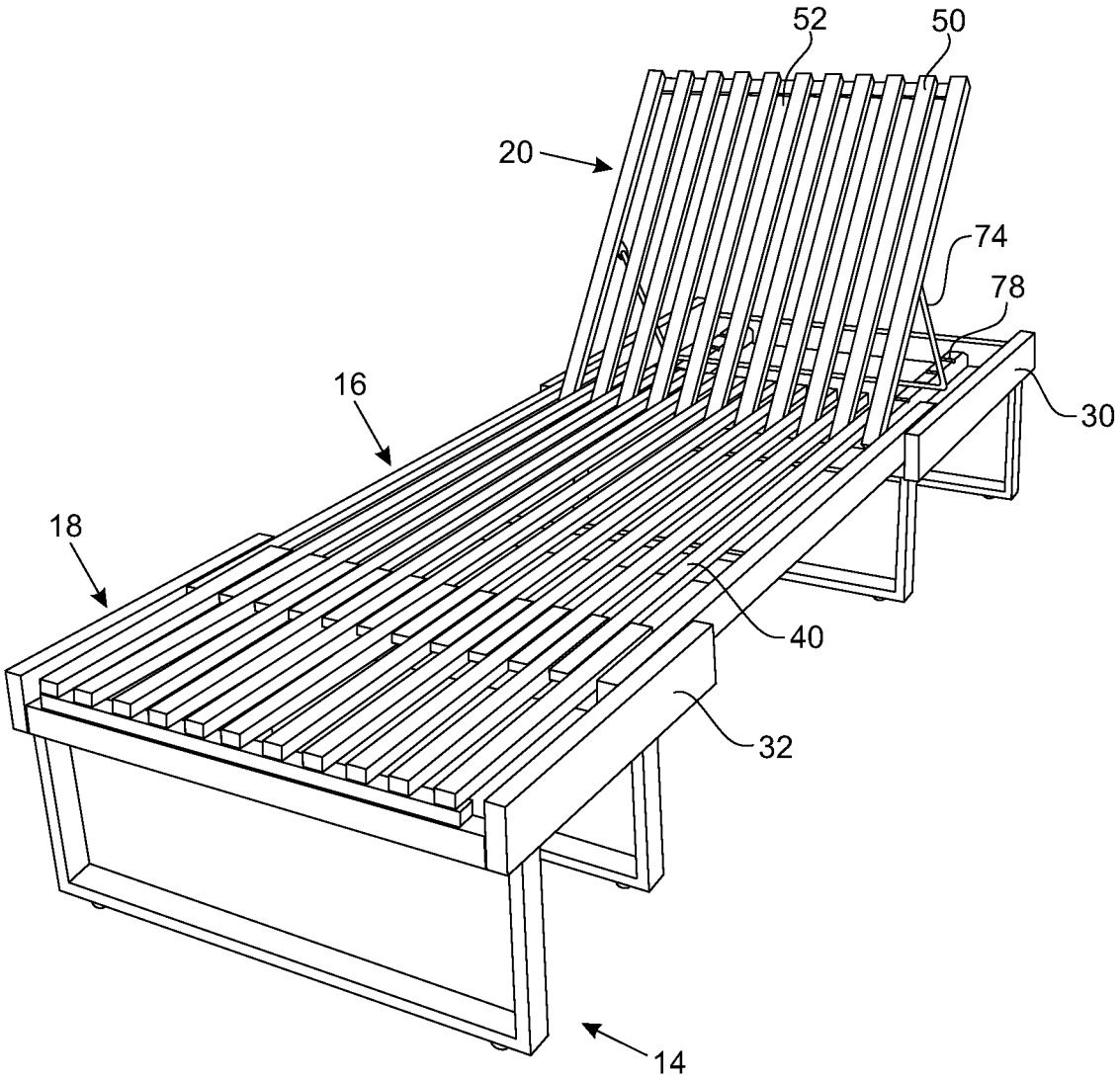
FIG. 3 is a front and side perspective view of the lounger is shown in FIG. 1 of the drawings, including dimensions for a preferred configuration.

Reference is now made to the accompanying drawings, which show embodiments of a lounger 10 in accordance with the invention. Note that other embodiments of loungers 10 may be provided within the scope of the invention, and the height, lengths, widths, frame design, use of slats and slat configuration, and other features may be adjusted or varied in accordance with the invention.

The figures show a lounger 10 comprising a support structure 12. The support structure 12 is supported by a plurality of support legs 14, and there are four such support legs 14 illustrated in the embodiment shown in the figures. These legs 14 are foldable between an open position as shown in the figures, and a closed position in which they are moved to be received within the support structure 12, or adjacent to it. The legs 14 shown in this embodiment are generally U-shaped brackets, but other types of legs 14 or support structure 12 supports may be used in the lounger 10 of the invention and fall within the scope of the invention.

The support structure 12 is generally rectangular in shape, and comprises a central seating portion 16, which will in use constitute the seating section of the lounger 10. The support structure 12 further comprises a back support portion 20 and a leg support portion 18. The central seating portion 16 has a first end 22, which connects to the back support portion 20, as will be described, and also a second end 24, which connects to the leg support portion 18, as will also be described. The back support portion 20 may be pivoted to adjust its orientation relative to the central seating portion 16, while the leg support portion 18 may be pivoted to adjust its orientation relative to the central seating portion 16. Both the back support portion 20 and the leg support portion 18 are potentially pivotable relative to the central seating portion 16 so that they are able to move between a position in which they are folded against or within the central seating 16, and a fully extended portion in which they been moved through approximately a 180° angle, or have been slid or telescoped relative thereto, as will be described.

A back support frame 30 is provided at one end of the lounger 18, while a leg support frame 32 is provided at the other end of the lounger 10. The back support frame 30 is designed to accommodate the back support portion 20, while the leg support frame 32 is designed to accommodate the leg support portion 18. Both of the back support frame 30 and the leg support frame 32 may also be pivotally or slidably mounted relative to the central seating portion 16 so that these frame 30 and 32 can also be moved between a substantially compact position on the one hand, and an extended position on the other.

The central seating portion 16 comprises a plurality of substantially parallel slats 40. Each of the slats 40 is separated from its adjacent slat 40 by a slat space 42. Each slat space 42 is substantially of the same width as a slat, or just slightly larger, so that other slats in the lounger 10, to be described, can be received within the slat spaces 42 when the lounger 10 is moved into a compact position for storage or transportation.

The slats 40 of the central seating portion 16 are mounted on one or more crossbeams 46, which keeps the slats 40 secure and properly spaced from each other.

The back support portion 20 is also comprised of a series of slats 50, which are essentially parallel to each other, and have slat spaces 52 between them. The back support portion 20 has a lower end 54 and an upper end 56. The slats 50 at the lower end 54 are accommodated within the slat space 42 between the slats 40 of the central seating portion 16. At the upper end 56, the slats 50 are mounted on a crossbeam 58. Each of the slats 50, at the lower end 54 thereof, can move pivotally or rotatably within the slat spaces 42, between the slats 40, so that the back support portion 20 can be rotated between a closed position, in which all of the slats 50 a substantially fully accommodated within the slat spaces 42, and the slats 40 of the central seating portion 16 are substantially accommodated within the slats spaces 52 of the back support portion 20. The back support portion 20 may be positioned at any selected orientation through these extreme positions.

The back support frame 30 surrounds the back support portion 20 when the back support portion 20 is in the fully extended position and coplanar with the central seating portion 16.

In a preferred embodiment, the central seating portion 16 and the back support portion 20 can, in one embodiment, be connected to each other by a rod or shaft which extends between registering apertures near the first end 22 of the slats 40, and near the lower end 54 of the slats 50 of the back support portion 20. In this way, the back support portion 20 is able to pivot or rotate about such rod or shaft, so that it can be angularly oriented with respect to the central seating portion 16 to a desired position selected by the user.

The leg support portion is also comprised of a plurality of parallel slats 60 which define therebetween slat spaces 62. The slat spaces 62 are dimensioned so that they are able to accommodate and receive slats 40 therein, from the central seating portion 16. Each of the slats 60 has an inner end 64 and an outer end 66. The slats 60 are mounted on one or more cross pieces 68, which supports them and maintains their spaced apart configuration to ensure that they can properly receive the slats 40 of the central seating portion 16. The leg support frame 32 surrounds the various slats 60.

In one preferred embodiment, the central seating portion 16 and the leg support portion 18 can be connected to each other by a rod or shaft which extends between registering apertures near the second end 24 of the slats 40 and the inner end 64 of the leg support portion 18. In this way, the leg support portion 18 is able to pivot or rotate about such rod or shaft, so that it can be angularly oriented with respect to the central seating portion 16 to a desired position selected by the user.

The leg support portion 18 may be moved into a closed position, wherein each of the slats 60 is substantially fully received within the slats spaces 42 of the central seating arrangement, and, correspondingly, the slats 40 are received within the slat spaces 62 of the leg support portion 18. The leg support portion 18 may be rotated or pivoted about the shaft or rod, and moved to a position in which it is extended outwardly, whether coplanar or at an angle, thereby providing support for the legs of the user. The leg support 18 may, in one embodiment, be angularly positioned at any specific point between opposing positions.

The leg support frame 32 is fixed with respect to, and moves with, the plurality of slats 60 which form the leg support portion 18. Independent rotational movement of the slats 62 relative to the leg support frame 32 is thus not possible in this embodiment of the invention. However, it will be seen that the back support portion 20 is movable relative to the back support frame 30. The back support frame 30 may also be rotated or pivoted between the open position, as shown for example in FIG. 1, so that it moves through approximately 180° to a closed position in which the leg support frame 32 overlies a part of the central seating portion 16. The leg support frame 32 is constructed so that it will not inhibit or prevent the receipt of the slats 40 within the slat spaces 62.

The back support frame 30 may be separate from the back support portion 20, and independently movable relative thereto. This allows the back support frame 30 to move between its position as shown in FIG. 1, in which it is extended, and a folded or compacted position in which it is rotated and pivoted over a part of the central seating portion 16, or slidably received within the slats and slats spaces. The back support frame 30 defines a space 70, which is able to receive the slats 40, so that the back support frame 30 can be fully folded. Independently, the back support portion 20 is movable so that it can be positioned at any angular desired point without requiring that the back support frame 30 be in a position other than the extended position as shown in FIG. 1. Attached to the back support frame 20 is a bracket 74 including a locking bar 76. The back support frame 30 includes a plurality of notches 78, and the locking bar 76 can be located in any one of the notches 78 so that the back support portion will be at the best desired angle relative to the central seating portion 16. Various other methods for securing the back support frame 20 in a desired angular position will also fall within the scope of the present invention.

A further embodiment of the lounger 10 is one where the back support portion 20 and the leg support portion 18 do not rotate to close, but operate on a sliding principle. Therefore, the leg support portion 18 will in this embodiment not rotate, but may slide over in a coplanar manner such that the slats 60 are received within the slat spaces 42 of the central seating portion 18. The slats 40 of the central seating portion 16 will slide into the slats spaces 62 of the leg support portion 18. In this embodiment, a ledge 80 is provided within the central seating portion 16 so that the outermost slats 60 on the leg support portion 18 will slide along the ledge 80. At the same time, the leg support frame 32 will slide with the movement of the slats 60.

In a sliding embodiment, the back support portion 20 may also close in a sliding motion rather than a rotating motion. When the slats 50 on the back support portion 20 are substantially horizontal, the back support portion 20 is a slidably moved so that the slats 50 are received within the slat spaces 42 of the central seating portion 16. At the same time, the slats 40 are received within the slat spaces 52 of the back support portion 20. The back support frame 30 may also slide to the closed position, in which it overlies the outermost slats 40 of the central seating portion 16.

The back support portion 20 and the leg support portion 18 are positioned such that both can be received, or substantially received by the central seating portion 20. The back support frame 30 and the leg support frame 32 will slide toward each other when the lounger 10 is being closed or compacted, and their ends will abut each other when each is in the fully closed position.

As noted above, the lounger 10 has four legs 14. Two of the legs are positioned at substantially opposing ends of the leg support frame 32, while the other two legs 14 are positioned at substantially opposing ends of the back support frame 30. All of the legs 14 have side posts 90 and a base 92. All of the legs 14 can be pivoted, rotated or otherwise moved so as to be in the extended position as shown in the figures, and a compact position in which the legs 14 are folded up against the back support frame 30 and the leg support frame 32 respectively. Preferably, when in the extended position, the legs 14 may have a releasable locking mechanism to keep them open or extended and operational, to ensure that the lounger 10 does not inadvertently collapse. There may also be locks or catches to hold the legs 14 in position once they are in the folded and tucked away position, to prevent them once more from inadvertently opening.

Figure 4:
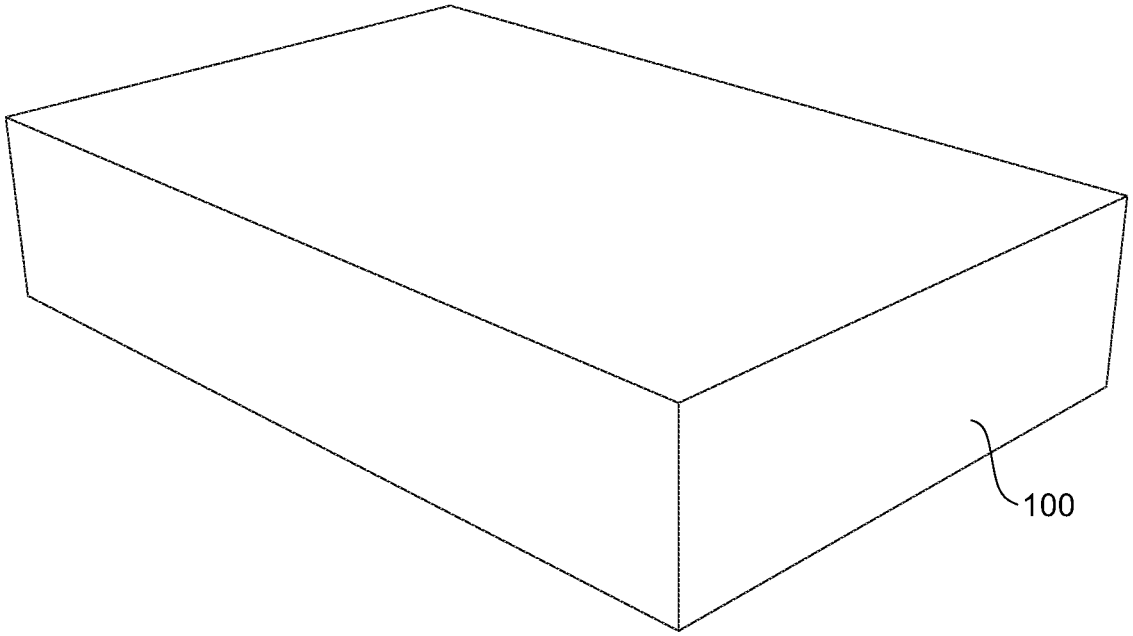
FIG. 4 shows a standard size carton used for transportation, the lounger of the invention being collapsible into parts and components which are designed to fit within such carton.

FIG. 4 of the drawings shows a carton 100, preferably of standard size used by courier services and transportation companies, and the lounger 10 of the invention may be folded, either by sliding as described above or rotation is also described above, so that the various slats thereof fit within the corresponding slat spaces, and the legs are received within the support frames 30 or 32.

Variations of the lounger 10 4 within the scope of the invention. Some lounges 10 may have a back support portion 20, but no lower leg support portion 18. The converse may also be true, wherein a leg support portion 18 is provided, but no back support portion 20. In the sliding embodiment of the invention, the lounger 10 can be easily collapsed by simply sliding both the back support portion 20 and its surrounding back support frame 30 into the spaces which are provided on the central seat portion 16, and the leg support portion 18 may be slid in the same manner, both comprising a type of telescoping motion. Prior to compacting, the legs 14 would be moved from the open locked position to a closed locked position to further minimize the amount of space which the lounger 10 would occupy when in the compacted condition.

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

The invention claimed is:

1. A sliding lounger comprising:

a seating portion comprising a plurality of substantially parallel seating slats and seating spaces between the seating slats;

a back support portion comprising a plurality of substantially parallel back slats and back spaces between the back slats, the back slats being receivable within the seating spaces and the seating slats being receivable within the back spaces;

a foot support portion comprising a plurality of substantially parallel foot slats and foot spaces between the foot slats, the foot slats being receivable within the seating spaces, and the seating slats being receivable within the foot spaces;

a plurality of legs for supporting the seating portion, back portion and foot support portion;

wherein the back support portion is movable between an open position in which at least a part of the back slats are not received within the seating spaces and a compact position in which the back slats are received within the seating spaces; and wherein the foot support portion is movable between an open position in which at least a part of the foot slats are not received within the seating spaces and a compact position in which the foot slats are received within the seating spaces.

2. The sliding lounger as claimed in claim 1 wherein the seating spaces comprise a width which is sufficient to accommodate the back slats and the foot slats.

3. The sliding lounger as claimed in claim 1 wherein the back slats are receivable within the seating slat spaces and the seating slats are receivable within the back spaces by sliding each into the other when coplanar with each other.

4. The sliding lounger as claimed in claim 1 wherein the foot slats are receivable within the seating slat spaces and the seating slats are receivable within the foot spaces by sliding each into the other when coplanar with each other.

5. The sliding lounger as claimed in claim 1 wherein the back support portion is angularly pivotable relative to the seating portion to a selected angular position.

6. The sliding lounger as claimed in claim 5 wherein the back support portion is selectively placed at any angular position.

7. The sliding lounger as claimed in claim 1 further comprising a back support frame in which the back support portion is located, the back support frame being slidable with the back support portion between an open position and a closed position, the back support frame being adjacent the seating portion when in the closed position.

8. The sliding lounger as claimed in claim 1 further comprising a foot support frame in which the foot support portion is located, the foot support frame being slidable with the foot support portion between an open position and a closed position, the foot support frame being adjacent the seating portion when in the closed position.

9. The sliding lounger as claimed in claim 1 wherein the legs are movable between an extended position for supporting the sliding lounger and a compact or folded position.

10. A method of making an operating a sliding lounger, the method comprising:

providing a seating portion comprising a plurality of substantially parallel seating slats and seating spaces between the seating slats;

providing a back support portion comprising a plurality of substantially parallel back slats and back spaces between the back slats, the back slats being receivable within the seating spaces and the seating slats being receivable within the back spaces;

providing a foot support portion comprising a plurality of substantially parallel foot slats and foot spaces between the foot slats, the foot slats being receivable within the seating spaces, and the seating slats being receivable within the foot spaces;

providing a plurality of legs for supporting the seating portion, back portion and foot support portion;

moving the back support portion between an open position in which at least a part of the back slats are not received within the seating spaces and a compact position in which the back slats are received within the seating spaces; and moving the foot support portion between an open position in which at least a part of the foot slats are not received within the seating spaces and a compact position in which the foot slats are received within the seating spaces.

* * * * *